US010766284B2

(12) United States Patent
Murayama et al.

(10) Patent No.: US 10,766,284 B2
(45) Date of Patent: Sep. 8, 2020

(54) TAPE CASSETTE

(71) Applicant: BROTHER KOGYO KABUSHIKI KAISHA, Nagoya-shi, Aichi-ken (JP)

(72) Inventors: Kentaro Murayama, Kasugai (JP); Haruki Matsumoto, Nagoya (JP); Tsutomu Kato, Nagoya (JP); Kohei Terada, Kiyosu (JP); Yukiko Takami, Inazawa (JP); Harumitsu Inoue, Toki (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 176 days.

(21) Appl. No.: 16/129,929

(22) Filed: Sep. 13, 2018

(65) Prior Publication Data

US 2019/0084323 A1 Mar. 21, 2019

(30) Foreign Application Priority Data

Sep. 21, 2017 (JP) ..... 2017-181708

(51) Int. Cl.
*B41J 15/04* (2006.01)
*B41J 17/36* (2006.01)
(Continued)

(52) U.S. Cl.
CPC ..... *B41J 15/044* (2013.01); *B41J 3/24* (2013.01); *B41J 3/4075* (2013.01); *B41J 3/44* (2013.01);
(Continued)

(58) Field of Classification Search
CPC ..... B41J 3/24; B41J 3/4075; B41J 3/44; B41J 11/008; B41J 11/46; B41J 11/66–11/70;
(Continued)

(56) References Cited

U.S. PATENT DOCUMENTS 6,624,903 B1 * 9/2003 Miquel ..... B41J 11/009 358/1.12
7,104,712 B2 * 9/2006 Sugimoto ..... B41J 3/4075 101/35
(Continued)

FOREIGN PATENT DOCUMENTS

JP 2004-026363 A 1/2004
JP 2010-208106 A 9/2010
(Continued)

*Primary Examiner* — Nguyen Q. Ha
(74) *Attorney, Agent, or Firm* — Scully, Scott, Murphy & Presser, PC

(57) ABSTRACT

A tape cassette includes: a cassette casing; and a tape roll that is a roll of a tape extending in a lengthwise direction and a widthwise direction. The tape includes: a subject surface exposed in a thickness direction; and a first image provided on the subject surface and indicating first information. The tape roll has: a first end portion located at an inner portion of the tape roll in a radial direction of the tape roll; and a second end portion located at an outer portion of the tape roll in the radial direction. The first information relates to an amount of a portion of the tape which is located on a first-end-portion-side of a reference position in the lengthwise direction. The reference position is located on the first-end-portion-side of the first image in the lengthwise direction on the tape at a particular distance from the first image.

14 Claims, 9 Drawing Sheets

(51) Int. Cl.

| | |
|---|---|
| ***B41J 29/46*** | (2006.01) |
| ***B41J 29/48*** | (2006.01) |
| ***B41J 35/36*** | (2006.01) |
| ***B41J 3/407*** | (2006.01) |
| ***B41J 3/44*** | (2006.01) |
| ***B41J 33/00*** | (2006.01) |
| ***B41J 3/24*** | (2006.01) |
| ***B41J 32/00*** | (2006.01) |
| ***B41J 11/00*** | (2006.01) |
| ***B41J 11/46*** | (2006.01) |
| ***B41J 35/28*** | (2006.01) |

(52) U.S. Cl.
CPC ..... *B41J 11/008* (2013.01); *B41J 11/46* (2013.01); *B41J 32/00* (2013.01); *B41J 33/003* (2013.01); *B41J 35/28* (2013.01)

(58) Field of Classification Search
CPC . B41J 15/04; B41J 15/044; B41J 17/36; B41J 29/46–29/48; B41J 32/00; B41J 33/003; B41J 35/28; B41J 35/36
See application file for complete search history.

(56) References Cited

U.S. PATENT DOCUMENTS

| | | | | |
|---|---|---|---|---|
| 7,971,953 | B2 * | 7/2011 | Ishii | B41J 11/0075 347/104 |
| 8,684,492 | B2 * | 4/2014 | Mitsuhashi | B41J 29/38 347/19 |
| 9,770,923 | B2 * | 9/2017 | Noguchi | B41J 15/04 |
| 2003/0095174 | A1 * | 5/2003 | Terasaki | G01P 3/487 347/217 |
| 2008/0239052 | A1 * | 10/2008 | Ishii | B41J 11/0075 347/104 |
| 2013/0202837 | A1 | 8/2013 | Ehara et al. | |
| 2015/0082744 | A1 * | 3/2015 | Tanaka | B41J 17/02 53/131.5 |
| 2018/0079233 | A1 * | 3/2018 | d'Armancourt | B65H 26/08 |

FOREIGN PATENT DOCUMENTS

| | | | |
|---|---|---|---|
| JP | 2010-221485 | A | 10/2010 |
| JP | 2012-201039 | A | 10/2012 |

* cited by examiner

TAPE CASSETTE

CROSS REFERENCE TO RELATED APPLICATION

The present application claims priority from Japanese Patent Application No. 2017-181708, which was filed on Sep. 21, 2017, the disclosure of which is herein incorporated by reference in its entirety.

BACKGROUND

The following disclosure relates to a tape cassette containing a tape on which a character or characters are printed.

There is conventionally known a technique in which a tape cassette contains a tape on which a character or characters are printed, and an indicator indicating predetermined information is printed on the tape. For example, there is known an elongated medium having (i) a plurality of scale holes arranged at regular intervals, (ii) a plurality of first indicator holes each indicating a reference position and arranged at regular intervals, and (iii) a plurality of second indicator holes. A distance between each of the plurality of second indicator holes and a corresponding one of the first indicator holes indicates a current remaining amount of the elongated medium. For example, a user can visually recognize a remaining amount of the elongated medium based on the number of the scale holes located between one of the first indicator holes and a corresponding one of the second indicator holes.

SUMMARY

To check a remaining amount of the tape, in general, the user visually checks an indicator provided on a printed tape discharged from a printer. In the case of the above-described elongated medium, for example, the user visually checks the elongated medium discharged from the printer and counts the number of the scale holes located between the first indicator hole and the second indicator hole to recognize the remaining amount of the elongated medium. The remaining amount of the elongated medium which is recognized by the user includes not only the length of the elongated medium remaining in the printer but also the length of the elongated medium having been discharged from the printer. This disallows the user to accurately recognize an amount of the elongated medium remaining in the printer, even if the user visually checks the indicator provided on the elongated medium discharged from the printer.

Accordingly, an aspect of the disclosure relates to a tape cassette enabling more accurate identification of an amount of a tape remaining in a printer.

In one aspect of the disclosure, a tape cassette includes: a cassette casing; and a tape roll that is contained in the cassette casing and that is a roll of a tape having a strip shape and extending in a lengthwise direction and a widthwise direction orthogonal to the lengthwise direction. The tape includes: a subject surface provided on the tape and exposed in a thickness direction orthogonal to each of the lengthwise direction and the widthwise direction; and a first image provided on the subject surface and indicating first information. The tape roll includes: a first end portion located at an inner portion of the tape roll in a radial direction of the tape roll; and a second end portion located at an outer portion of the tape roll in the radial direction, and the first end portion and the second end portion are opposite end portions of the roll of the tape in the lengthwise direction.

The first information relates to a remaining amount of the tape that is an amount of a portion of the tape which is located on a first-end-portion-side of a reference position in the lengthwise direction in the tape roll. The reference position is located on the first-end-portion-side of the first image in the lengthwise direction on the tape at a particular distance from the first image.

BRIEF DESCRIPTION OF THE DRAWINGS

The objects, features, advantages, and technical and industrial significance of the present disclosure will be better understood by reading the following detailed description of the embodiment, when considered in connection with the accompanying drawings, in which.

DETAILED DESCRIPTION OF THE EMBODIMENT

Figure 1:
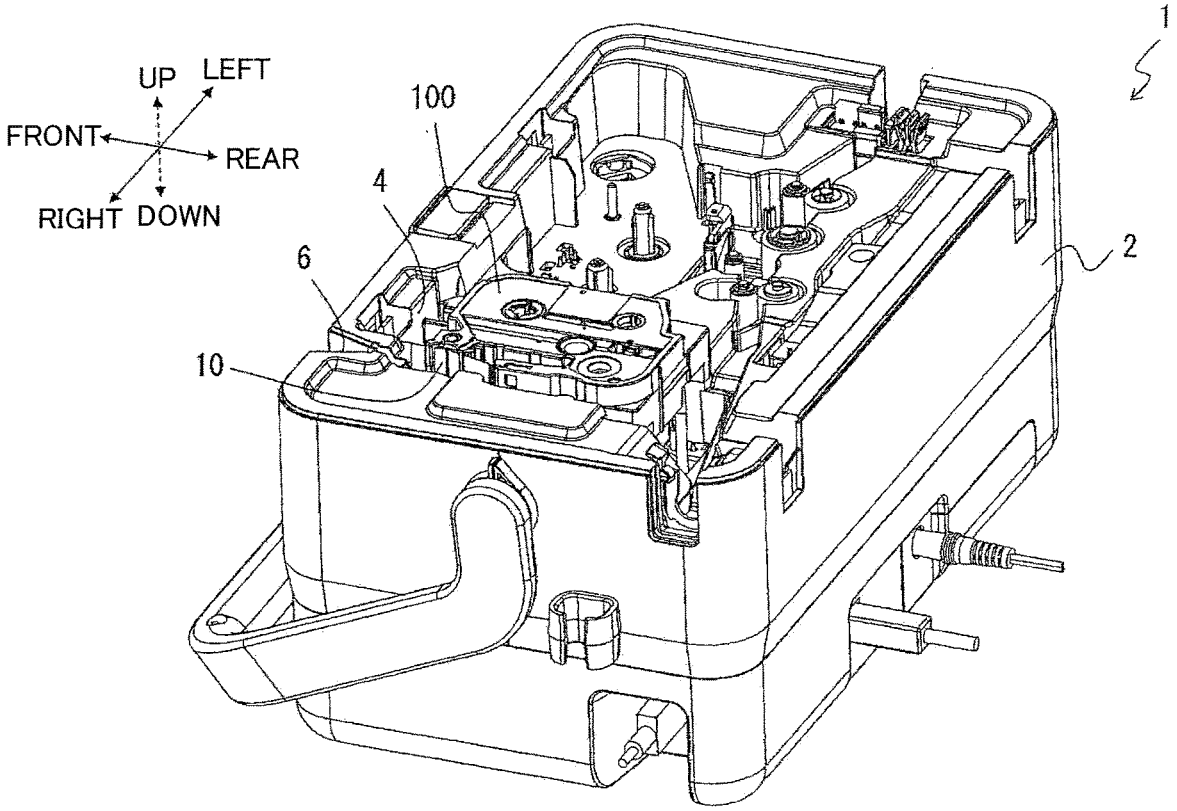
FIG. 1 is a perspective view illustrating an external appearance of a printer 1, with a cover omitted.

Hereinafter, there will be described one embodiment by reference to the drawings. The drawings are for explanation of technical features employable in the present disclosure. It is to be understood that the configuration illustrated in the drawings does not limit the present disclosure and is only one example.

There will be described a printer 1 and a tape cassette 100 according to the present embodiment with reference to FIGS. 1-7. The upper left side, the lower right side, the upper right side, the lower left side, the upper side, and the lower side in FIG. 1 are defined respectively as the front side, the rear side, the left side, the right side, the upper side, and the lower side of the printer 1 and the tape cassette 100. As illustrated in FIGS. 1-5, the printer 1 according to the present embodiment is capable of selectively performing printing on a tape 10 and printing on a tube, not illustrated. The printer 1 at least needs to be capable of performing printing on the tape 10. The following description is given only for a mechanism of the printer 1 which relates to printing on the tape 10. The printer 1 may use various types of the tape cartridge 100 such as a thermal type, a receptor type, and a laminate type. The tape cassette 100 is of the receptor type in the present embodiment.

As illustrated in FIG. 1, the printer 1 includes: a main body 2 shaped like a substantially rectangular parallelepiped box; and a cover, not illustrated, capable of closing an opening formed in an upper portion of the main body 2. A cartridge holder 4 is provided at a right portion of an upper surface of the main body 2. The cartridge holder 4 is a recess in which the tape cartridge 100 is removably mountable. An output opening 6 is formed in a right portion of a front surface of the main body 2. The tape 10 having been printed is discharged from the cartridge holder 4 to the outside of the printer 1 through the output opening 6.

Figure 2:
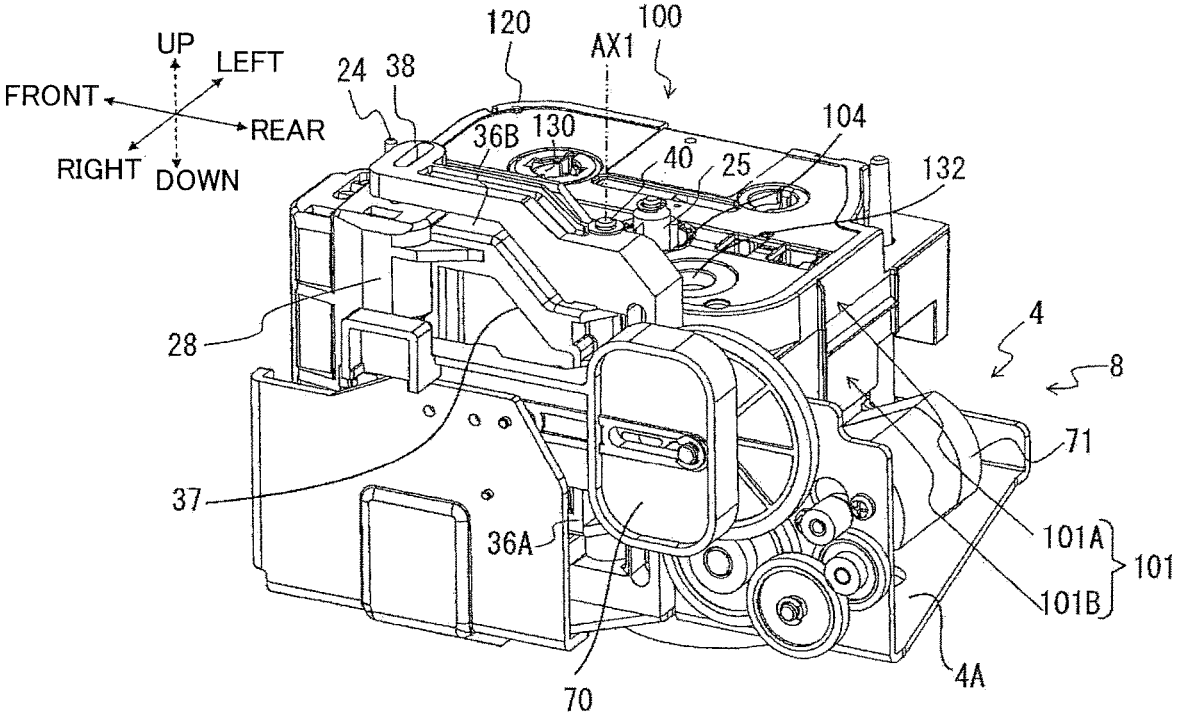
FIG. 2 is a perspective view of an internal unit 8.
Figure 3:
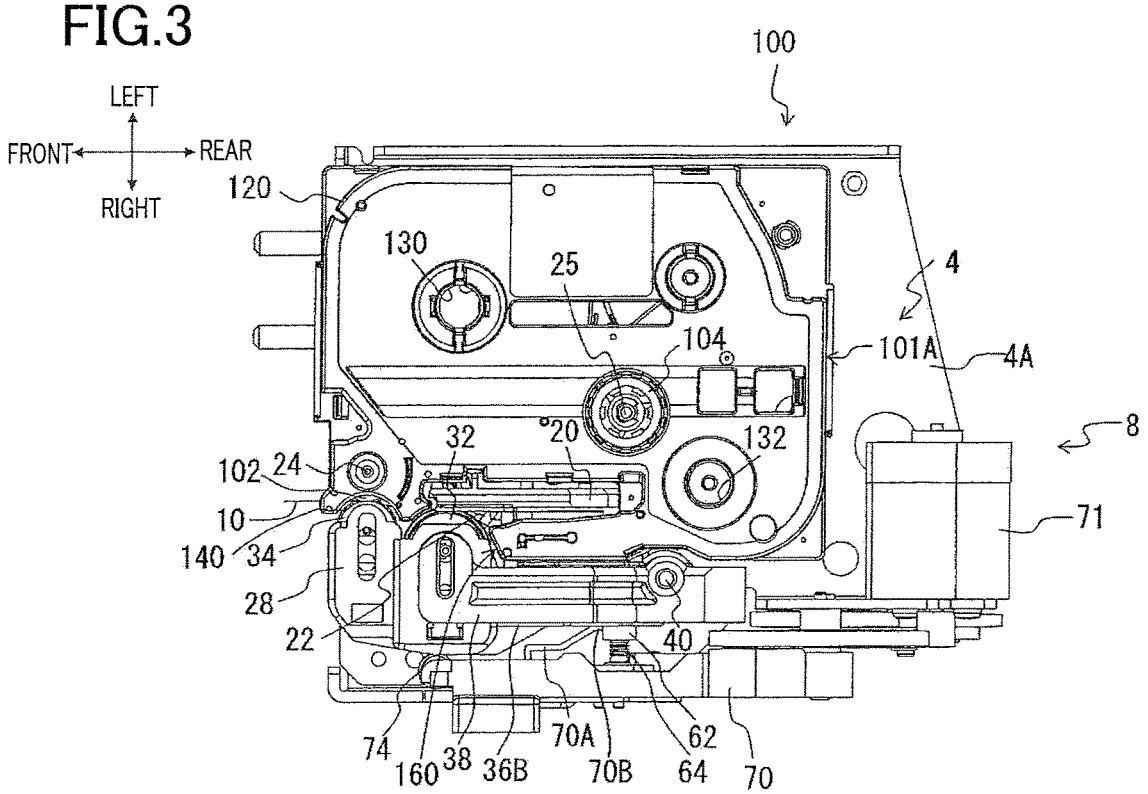
FIG. 3 is a plan view of the internal unit 8.
Figure 4:
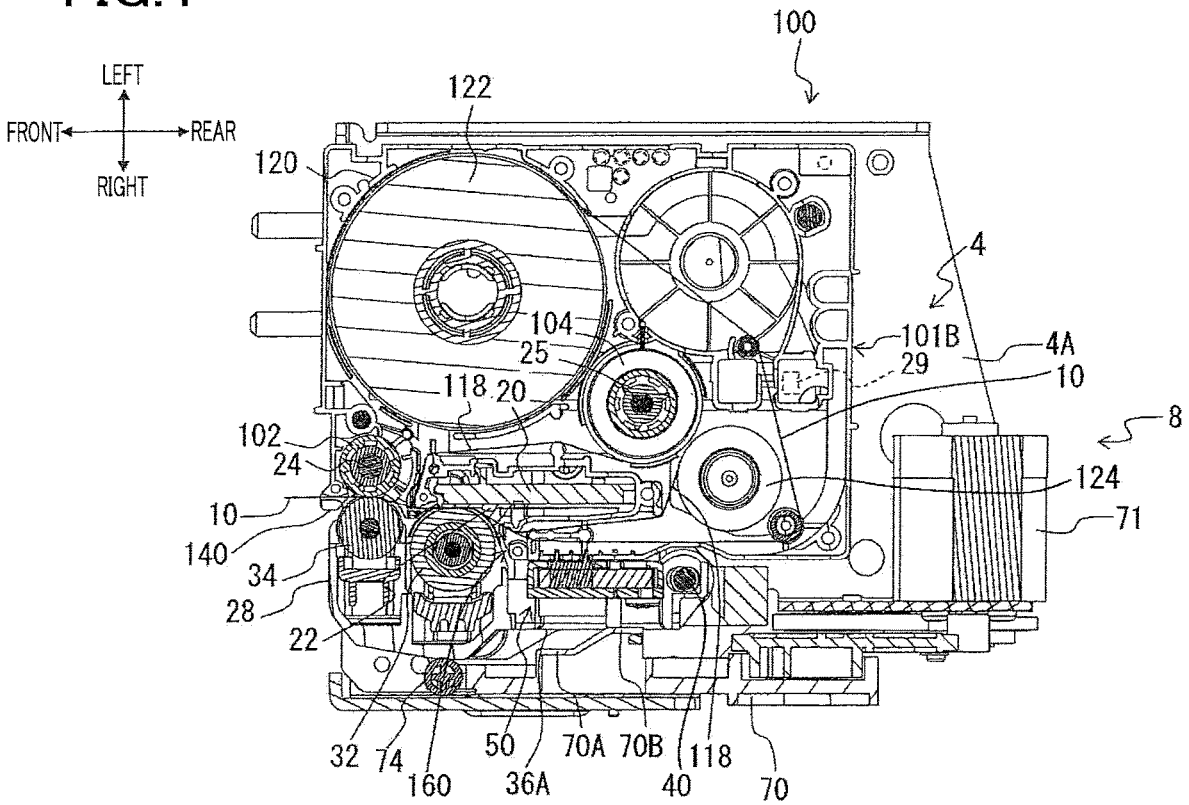
FIG. 4 is a cross-sectional view of the internal unit 8.

As illustrated in FIGS. 2-4, an internal unit 8 is provided at a right portion of the main body 2. The internal unit 8 includes a bottom plate 4A that constitutes a bottom surface of the cartridge holder 4. A head holder 20 is provided upright at a right portion of a substantially central portion of the cartridge holder 4 in the front and rear direction. A thermal head 22 including heating elements, not illustrated, is provided on a right surface of the head holder 20. The thermal head 22 performs printing on the tape 10 conveyed along a predetermined conveyance path by, e.g., a platen roller 32 which will be described below. A ribbon take-up shaft 25 is provided upright on the cartridge holder 4 at a position located to the left of the head holder 20. A conveying-roller drive shaft 24 is provided upright on the cartridge holder 4 at a position located in front of the head holder 20. When the tape cassette 100 is mounted on the cartridge holder 4, the ribbon take-up shaft 25 is inserted and fitted in a ribbon take-up roller 104 which will be described below, and the conveying-roller drive shaft 24 is inserted and fitted in a conveying roller 102 which will be described below.

A drive motor, not illustrated, as a stepping motor is provided in the main body 2 at a position located outside the cartridge holder 4. The ribbon take-up shaft 25, the conveying-roller drive shaft 24, and the platen roller 32 which will be described below are connected to a drive motor via a plurality of gears, not illustrated, and rotated by power generated by the drive motor. As a result, the ribbon take-up shaft 25 fitted in the ribbon take-up roller 104 rotates the ribbon take-up roller 104. The conveying-roller drive shaft 24 fitted in the conveying roller 102 rotates the conveying roller 102. The platen roller 32 conveys the tape 10 and an ink ribbon 118 as will be described below.

As illustrated in FIGS. 2 and 4, the tape cassette 100 according to the present embodiment includes a cassette casing 101 having a substantially rectangular parallelepiped shape. The cassette casing 101 includes an upper first casing portion 101A and a lower second casing portion 101B. The casing portions 101A, 101B are fixed to each other as one unit. A roll storage 120 provided in the cassette casing 101 stores: a tape roll 122 that is a roll of the tape 10; and a ribbon roll 124 that is a roll of the ink ribbon 118. The tape roll 122 is rotatably supported in a support hole 130 at a front left portion of the roll storage 120. The ribbon roll 124 is rotatably supported in a support hole 132 at a rear right portion of the roll storage 120. The ribbon take-up roller 104 is rotatably supported by a shaft between the tape roll 122 and the ribbon roll 124 in the cassette casing 101. The ribbon take-up roller 104 is rotated by the ribbon take-up shaft 25 to draw the ink ribbon 118 from the ribbon roll 124 and take up the used ink ribbon 118. The ink ribbon 118 has black ink, for example. Specifically, the ink ribbon 118 has an ink layer and a substrate. The substrate is formed of resin such as polyethylene terephthalate (PET). The ink layer contains a color component and a binder component such as wax and/or resin. In the case where the ink ribbon 118 has black ink, the color component contained in the ink layer is carbon, for example.

As illustrated in FIGS. 3-6, the cassette casing 101 includes an arm 160 extending frontward from a rear right portion of the roll storage 120. The arm 160 includes: a first arm 160A located near the first casing portion 101A; and a second arm 160B located near the second casing portion 101B. An unused tape 10 drawn from the tape roll 122 and an unused ink ribbon 118 drawn from the ribbon roll 124 are guided in the arm 160. The tape 10 is guided in the arm 160 in a state in which the widthwise direction of the tape 10 is parallel with the up and down direction, a fourth surface 12B of a printing sheet 12 (see FIGS. 8-10) which will be described below faces leftward, and a first surface 11A of a separation sheet 11 (see FIGS. 8-10) which will be described below faces rightward. The ink ribbon 118 is guided in the arm 160 at a position located to the left of the tape 10 in a state in which the widthwise direction of the tape 10 is parallel with the up and down direction. After guided frontward in the arm 160, the tape 10 and the ink ribbon 118 are arranged on one another in an opening 161 formed in the front end of the arm 160 and are discharged frontward from the arm 160.

The conveying roller 102 is rotatably supported by a shaft in the cassette casing 101 at a position located in front of the arm 160. An output guide 140 is provided at a front right corner of the cassette casing 101. A pressing roller 34, which will be described below, is opposed to the conveying roller 102. When rotated by the conveying-roller drive shaft 24, the conveying roller 102 is cooperated with the pressing roller 34 to draw the tape 10 from the tape roll 122 and convey the printed tape 10 toward the output opening 6 via the output guide 140. It is noted that the ink ribbon 118 is guided toward the ribbon take-up roller 104 at a position located upstream of the conveying roller 102 in the conveying direction.

Figure 6:
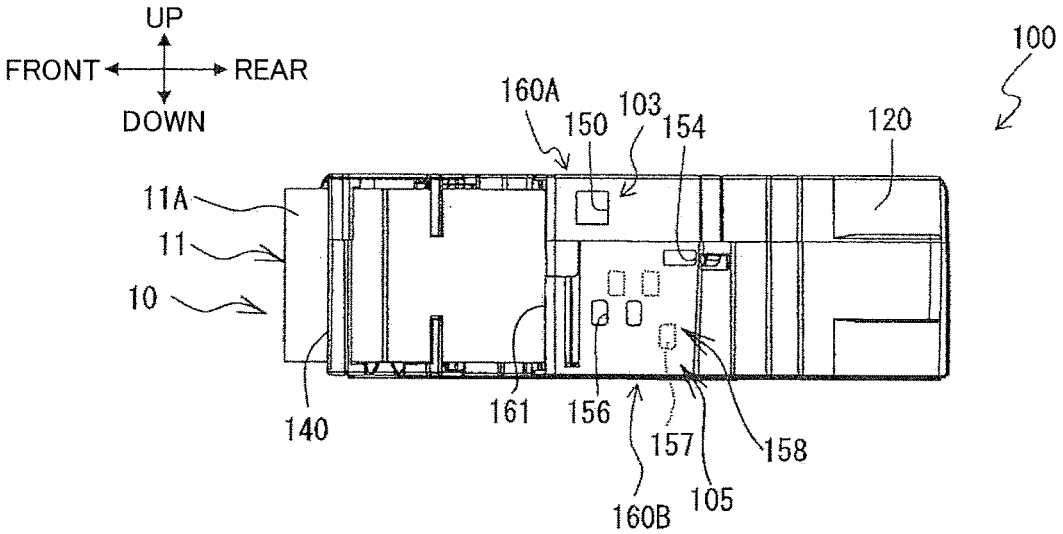
FIG. 6 is a right side view of a tape cassette 100.

As illustrated in FIG. 6, the first casing portion 101A includes a right wall 103 of the first arm 160A. The right wall 103 has a detection hole 150 extending through the right wall 103 and having a substantially rectangular shape. The detection hole 150 is formed at a position opposed to a path of movement of label markers 42 and remaining-amount markers 43 (see FIG. 10) which will be described below, provided on the tape 10 conveyed in the arm 160. The detection hole 150 is used for an optical sensor 56 (see FIG. 7), which will be described below, to optically detect the label markers 42 and the remaining-amount markers 43.

The second casing portion 101B includes a right wall 105 of the second arm 160B which is located under the right wall 103 of the first arm 160A. The right wall 105 has: an indicator portion 158 indicating information relating to the tape 10; and an insertion hole 154 having a substantially rectangular shape. The indicator portion 158 defines the information relating to the tape 10, such as the width of the tape 10, in accordance with combinations of insertion holes 156 or surface portions 157 respectively corresponding to sensor protrusions 66 which will be described below. The insertion hole 154 is a hole into which a guide protrusion 58 (see FIG. 7) which will be described below is inserted.

As illustrated in FIGS. 2-5, a pivotably supporting portion 38 having a three-sided rectangular shape extending in the front and rear direction is provided to the right of the head holder 20 in the cartridge holder 4. The pivotably supporting portion 38 supports holder arms 36A, 36B each extending in the front and rear direction, such that the holder arms 36A, 36B are interposed between opposed portions of the pivotably supporting portion 38. Each of the holder arms 36A, 36B is pivotable about an axis AX1 by a support shaft 40 extending in the up and down direction. The first holder arm 36A is disposed in a lower portion of an inner space of the pivotably supporting portion 38. The second holder arm 36B is disposed in an upper portion of the inner space of the pivotably supporting portion 38, that is, the second holder arm 36B is disposed above the first holder arm 36A.

A roller holder 28 is supported by the holder arms 36A, 36B so as to be pivotable about the axis AX1 with the holder arms 36A, 36B. The platen roller 32 and the pressing roller 34 are rotatably provided on the roller holder 28. The platen roller 32 is opposed to the thermal head 22 such that a roller surface of the platen roller 32 is exposed leftward. The pressing roller 34 is opposed to the conveying-roller drive shaft 24 such that a roller surface of the pressing roller 34 is exposed leftward.

A torsion spring, not illustrated, is mounted on a lower end portion of the support shaft 40. The torsion spring resiliently urges the holder arms 36A, 36B and the roller holder 28 rightward (away from the thermal head 22) about the axis AX1. In a state in which each of the holder arms 36A, 36B and the roller holder 28 is not pressed leftward (toward the thermal head 22), each of the holder arms 36A, 36B and the roller holder 28 is kept at a release position (illustrated in FIG. 5) by an urging force of the torsion spring. In the case where each of the holder arms 36A, 36B and the roller holder 28 is located at the release position, the platen roller 32 and the pressing roller 34 are separated respectively from the thermal head 22 and the conveying roller 102.

When pressed rightward against the urging force of the torsion spring, each of the holder arms 36A, 36B and the roller holder 28 pivots rightward from the release position to a printing position (illustrated in FIGS. 3 and 4). In the case where each of the holder arms 36A, 36B and the roller holder 28 is located at the printing position, the platen roller 32 and the pressing roller 34 presses the tape 10 located on the conveyance path, respectively against the thermal head 22 and the conveying roller 102. When the platen roller 32, the pressing roller 34, and the conveying-roller drive shaft 24 (the conveying roller 102) are rotated in the state in which the tape cassette 100 is mounted on the cartridge holder 4, and each of the holder arms 36A, 36B and the roller holder 28 is located at the printing position, the tape 10 contained in the tape cassette 100 is conveyed along the predetermined conveyance path.

Figure 5:
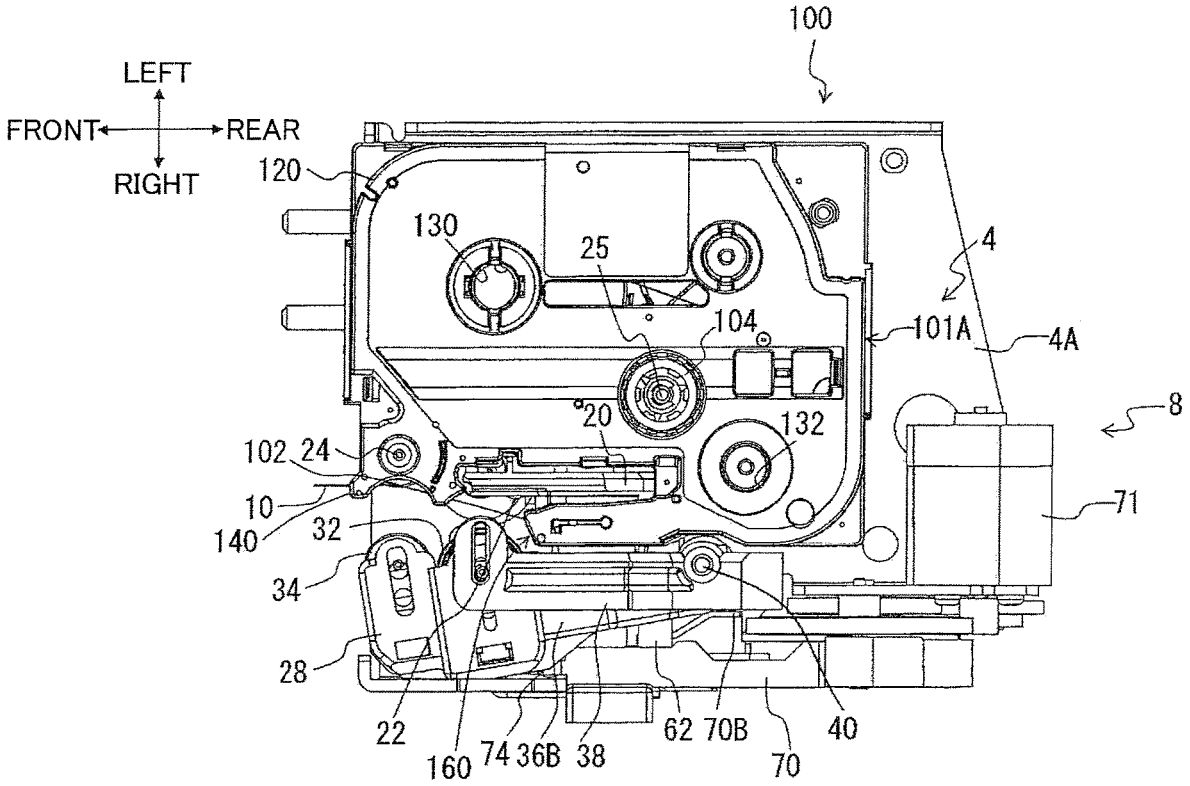
FIG. 5 is a plan view of the internal unit 8.

As illustrated in FIGS. 3-5, a release rod 70 and a release motor 71 are provided on the main body 2. The release rod 70 is disposed to the right of the holder arms 36A, 36B so as to extend in the front and rear direction. A left portion of the release rod 70 includes a first engaging portion 70A and a second engaging portion 70B. The first engaging portion 70A extends on a front right side of the second engaging portion 70B. The release motor 71 is mechanically coupled to the release rod 70 and driven to move the release rod 70 in the front and rear direction.

A pressing portion 74 shaped like a roller is provided at a front end portion of the release rod 70. When the release rod 70 is moved frontward by the release motor 71, the pressing portion 74 is also moved frontward and brought into contact with the roller holder 28. With this operation, each of the holder arms 36A, 36B and the roller holder 28 is rotated rightward about the axis AX1 and thereby moved from the release position to the printing position. When the release rod 70 is moved rearward by the release motor 71, the pressing portion 74 is moved rearward and thereby separated from the roller holder 28. This separation causes each of the holder arms 36A, 36B and the roller holder 28 to be rotated leftward about the axis AX1 and thereby moved from the printing position to the release position.

As illustrated in FIG. 4, a sensor 29 is provided on a rear portion of the cartridge holder 4 at a substantially center of the cartridge holder 4 in the right and left direction. The sensor 29 optically detects a terminal-end mark, not illustrated, provided on the tape 10 of the tape cassette 100 mounted on the cartridge holder 4. The terminal-end mark will be described later.

Figure 7:
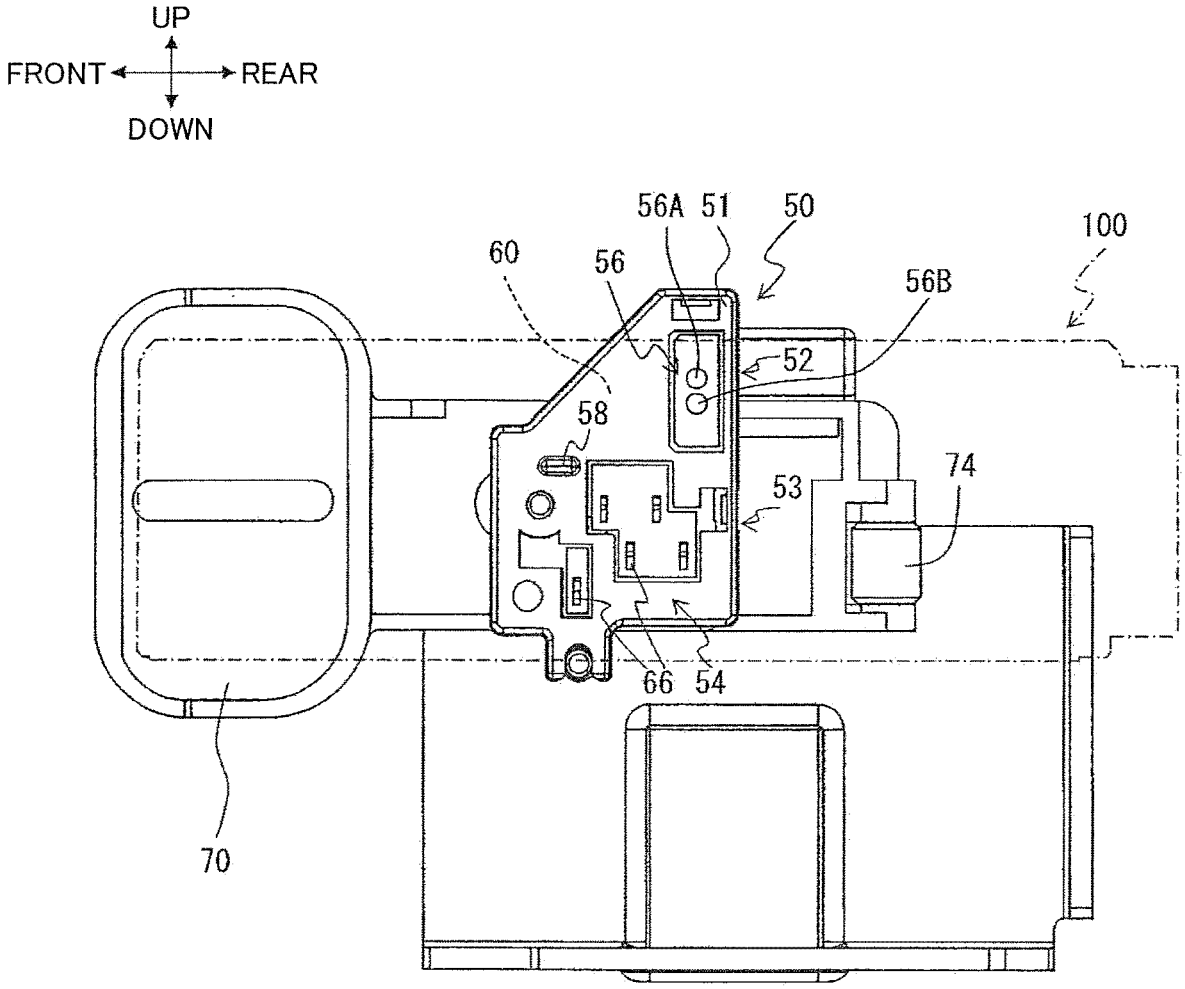
FIG. 7 is a plan view of a sensor unit 50 and components around the sensor unit 50.

As illustrated in FIG. 7, a sensor unit 50 movable with respect to the tape cassette 100 mounted on the cartridge holder 4 is provided to the left of the release rod 70 in the main body 2. The sensor unit 50 includes a mechanical sensor 54 and the optical sensor 56 as one unit. The sensor unit 50 is inserted in a space 37 (see FIG. 2) formed between the holder arms 36A, 36B. The space 37 is located upstream of the thermal head 22 in the conveying direction. The sensor unit 50 includes a circuit board 60 shaped like a plate and a unit body 51 shaped like a box. The circuit board 60 is located to the right of the unit body 51. The circuit board 60 is connected to a control circuit, not illustrated, of the printer 1 via a cable, not illustrated, connected to a connector, not illustrated, provided on the circuit board 60.

The mechanical sensor 54 includes a plurality of the sensor protrusions 66 (five sensor protrusions 66 in this example) provided at a substantially quadrangle portion 53 of a left surface of the circuit board 60. Each of the sensor protrusions 66 protrudes through an opening formed in the unit body 51, to a position located to the left of a left surface of the unit body 51. When the tape cassette 100 is mounted on the cartridge holder 4, and the sensor unit 50 is moved to a detecting position which will be described later, the indicator portion 158 (see FIG. 6) of the arm 160 is opposed to one or ones of the sensor protrusions 66. The sensor protrusions 66 opposed to the insertion holes 156 (see FIG. 6) are inserted in the insertion holes 156 and set at OFF. The sensor protrusions 66 opposed to the surface portions 157 (see FIG. 6) are pressed by the surface portions 157 and set at ON. The control circuit, not illustrated, of the printer 1 detects information about the width of the tape 10 based on combination of ON and OFF of the sensor protrusions 66.

The optical sensor 56 is provided on a substantially triangle portion 52 of the left surface of the circuit board 60. The optical sensor 56 is a reflective optical sensor capable of optically detecting an object through the opening formed in the unit body 51. The optical sensor 56 includes a light emitting element 56A and a light receiving element 56B arranged in the up and down direction. The light emitting element 56A is a light-emitting diode (LED) configured to emit near-infrared light (0.8 μm to 1.0 μm), for example. The light receiving element 56B is a photodiode having sensitivity to the near-infrared light, for example. When the tape cassette 100 is mounted on the cartridge holder 4, and the sensor unit 50 is moved to the detecting position which will be described later, the detection hole 150 formed in the arm 160 (see FIG. 6) is opposed to the optical sensor 56. When light emitted from the light emitting element 56A into the detection hole 150, the light illuminates a portion of the tape 10 which is opposed to the detection hole 150. The light receiving element 56B receives light reflected from the tape 10 via the detection hole 150. The control circuit, not illustrated, of the printer 1 is capable of detecting various kinds of information relating to the tape 10 based on a result of detection of the optical sensor 56, but the detail of which will be described later. It is noted that the optical sensor 56 may be of a transmission type.

The guide protrusion 58 is provided at an upper rear portion of the substantially quadrangle portion 53 of the unit body 51. When the tape cassette 100 is mounted on the cartridge holder 4, and the sensor unit 50 is moved to the detecting position which will be described later, the insertion hole 154 (see FIG. 6) formed in the arm 160 is opposed to the guide protrusion 58, and the guide protrusion 58 is inserted in the insertion hole 154.

A cylindrical portion 62 (see FIG. 3) is provided at the substantially quadrangle portion 53 of the unit body 51 so as to extend to a position located to the right of a right surface of the circuit board 60, via the through hole formed in the circuit board 60. A coil spring 64 (see FIG. 3) is provided in the cylindrical portion 62. The coil spring 64 resiliently urges the sensor unit 50 leftward. A guide portion, not illustrated, extending downward is provided near a right end portion of the cylindrical portion 62. The guide portion of the cylindrical portion 62 is engaged with the first engaging portion 70A or the second engaging portion 70B (see FIG. 3) of the release rod 70. Leftward movement of the sensor unit 50 by the urging force of the coil spring 64 is inhibited by the engagement between the guide portion and the first engaging portion 70A or the second engaging portion 70B.

When the release rod 70 is moved frontward by the release motor 71, the guide portion of the cylindrical portion 62 is moved from the first engaging portion 70A to the second engaging portion 70B with leftward movement of the sensor unit 50. When the guide portion of the cylindrical portion 62 is engaged with the second engaging portion 70B, the sensor unit 50 is kept at the detecting position (illustrated in FIGS. 3 and 4). When the sensor unit 50 is located at the detecting position, the sensor protrusions 66 of the mechanical sensor 54 are opposed to the indicator portion 158, the guide protrusion 58 is inserted in the insertion hole 154, and the optical sensor 56 is opposed to the detection hole 150.

When the release rod 70 is moved rearward by the release motor 71, the guide portion is moved from the second engaging portion 70B to the first engaging portion 70A with rightward movement of the sensor unit 50. When the guide portion of the cylindrical portion 62 is engaged with the first engaging portion 70A, the sensor unit 50 is kept at the release position (illustrated in FIG. 5). When the sensor unit 50 is located at the release position, the sensor protrusions 66 of the mechanical sensor 54 are separated from the indicator portion 158, the guide protrusion 58 is separated from the insertion hole 154, and the optical sensor 56 is separated from the detection hole 150.

Figure 8:
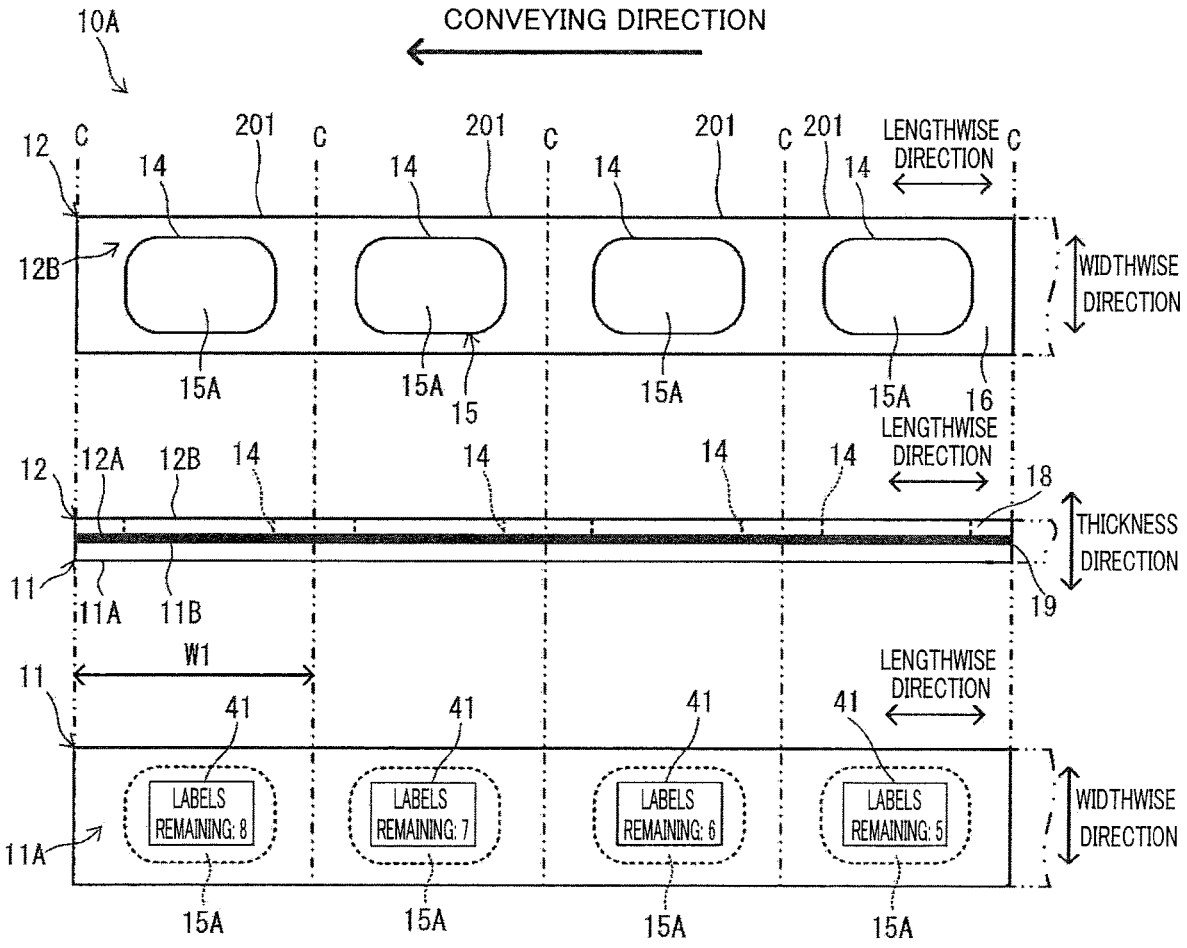
FIG. 8 is a view for explaining a tape 10A.
Figure 9:
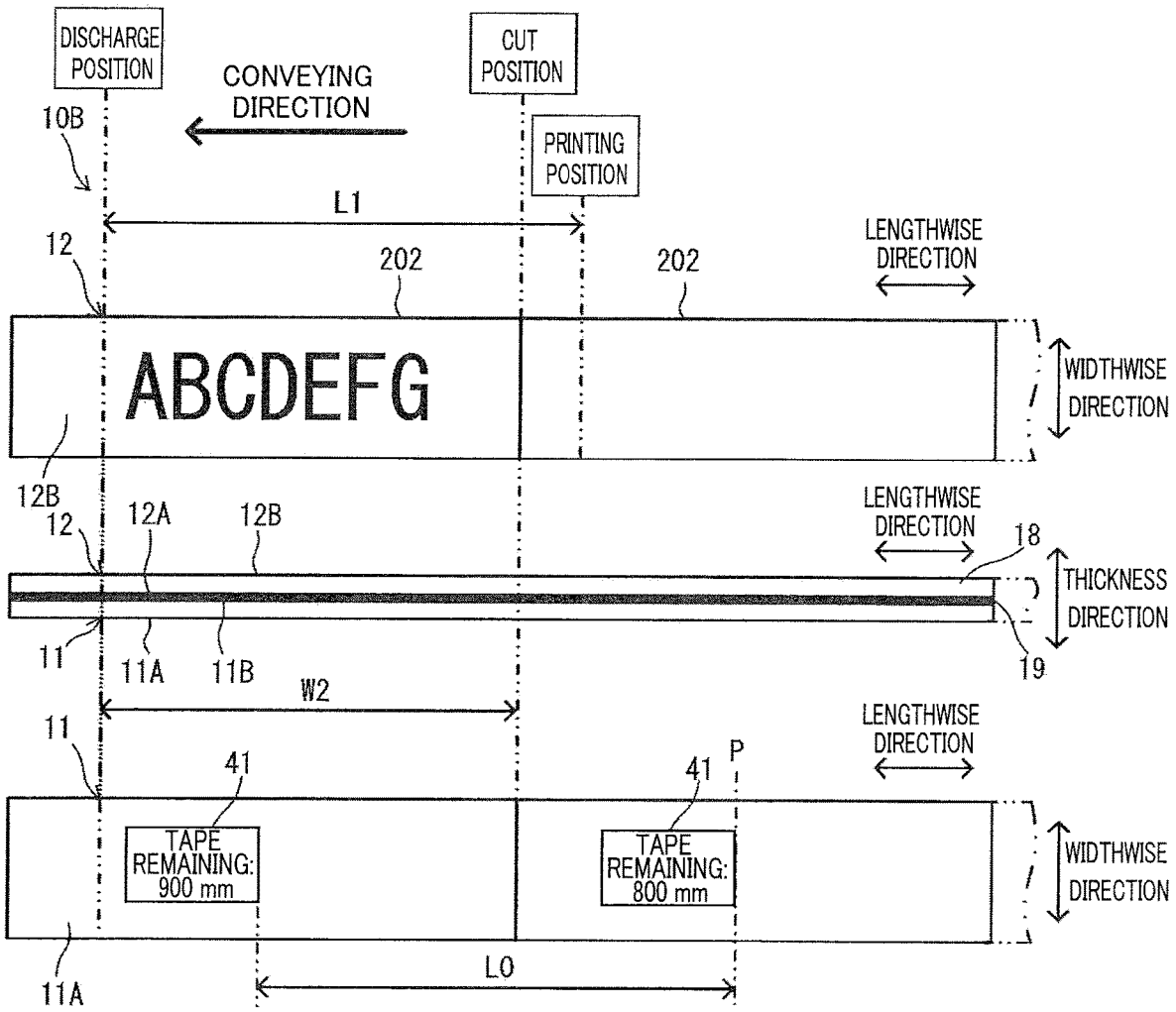
FIG. 9 is a view for explaining a tape 10B.
Figure 10:
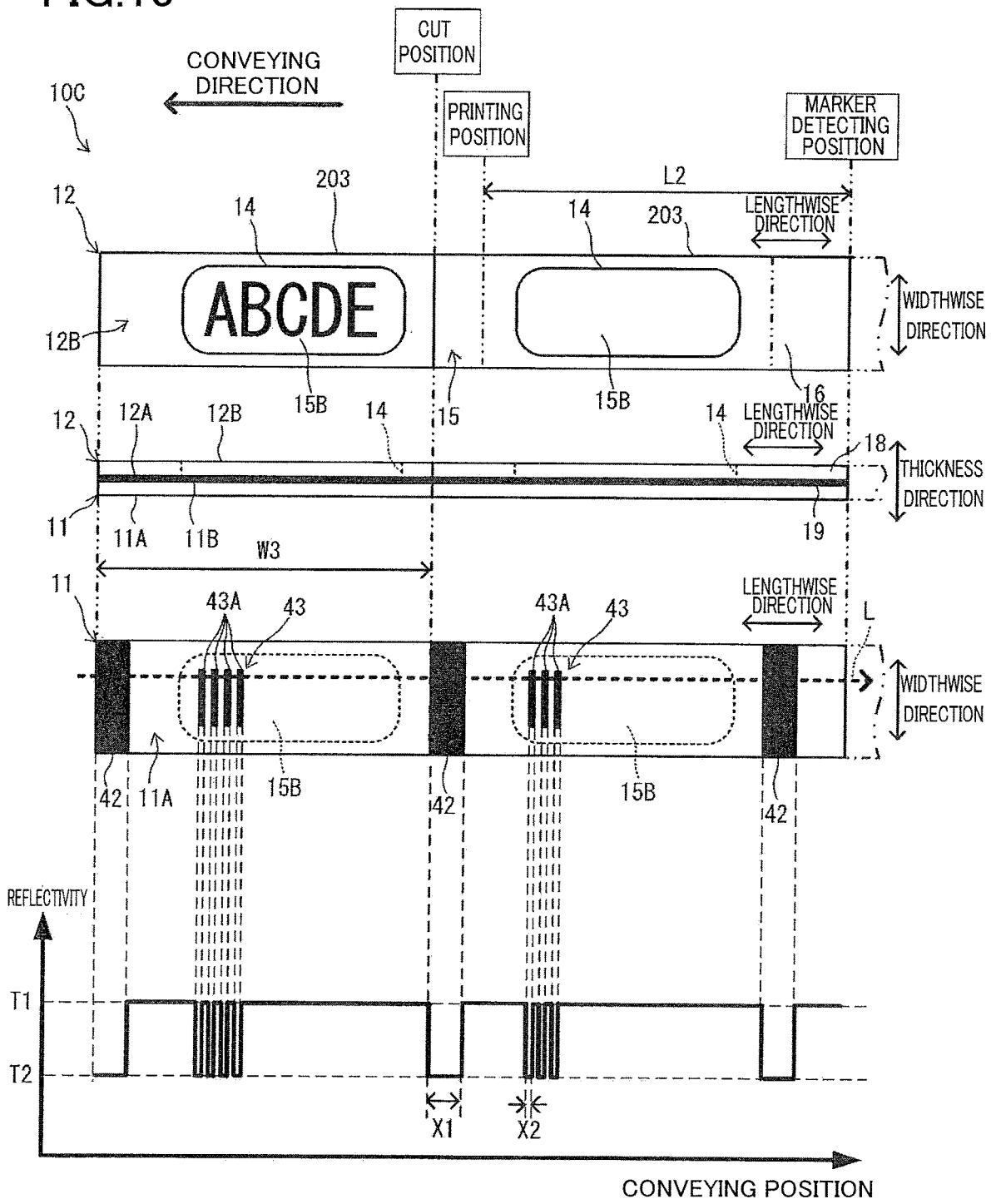
FIG. 10 is a view for explaining a tape 10C.

There will be next described a configuration of the tape 10 with reference to FIGS. 8-10. A tape 10A illustrated in FIG. 8 is a first example of the tape 10. A tape 10B illustrated in FIG. 9 is a second example of the tape 10. A tape 10C illustrated in FIG. 10 is a third example of the tape 10. As illustrated in FIGS. 8-10, the tape 10 is shaped like a strip extending in its lengthwise direction and its widthwise direction. The lengthwise direction coincides with a direction in which the tape 10 of the tape roll 122 (see FIG. 4) is drawn and conveyed by the printer 1 (see FIG. 1). The widthwise direction coincides with a direction orthogonal to the lengthwise direction and corresponds to the widthwise direction of the tape 10. The direction of the tape 10 which is orthogonal to each of the lengthwise direction and the widthwise direction is a thickness direction.

The tape 10 includes the separation sheet 11 and the printing sheet 12. The separation sheet 11 has opposite surfaces in the thickness direction, namely, the first surface 11A and a second surface 11B. In the present example, the separation sheet 11 is release paper (such as glassine, high-quality paper, or kraft paper) covered with a release agent formed of a silicon-based material, for example. The separation sheet 11 may be formed of a material other than the release paper. For example, the separation sheet 11 may be a release film formed of a resin film. The color of each of the first surface 11A and the second surface 11B is white corresponding to the ground color of the separation sheet 11. The printing sheet 12 has a printing layer 18 and an adhesive layer 19 stacked on each other in the thickness direction. The printing layer 18 has opposite surfaces in the thickness direction, namely, a third surface 12A and the fourth surface 12B. The printing layer 18 is a film formed of resin such as PET, PVC, PP, PE, PS, and ABS. The adhesive layer 19 is a transparent layer formed of adhesive and disposed on the third surface 12A. The adhesive layer 19 contains acrylic adhesive, for example. In the present example, the ground color of the printing layer 18 is white. The color of each of the third surface 12A and the fourth surface 12B is white corresponding to the ground color of the printing layer 18. The printing sheet 12 is peelably stuck to the second surface 11B, with the adhesive layer 19 interposed therebetween. The thermal head 22 (see FIG. 4) forms an image on the fourth surface 12B by thermal transfer of the ink ribbon 118.

To form the tape roll 122 (see FIG. 4), the tape 10 according to the present embodiment is rolled in a state in which the printing sheet 12 is located on an inner circumferential side, and the separation sheet 11 is located on an outer circumferential side. The tape roll 122 has: a first end portion located on an inner portion of the tape roll 122 in its radial direction; and a second end portion located on an outer portion of the tape roll 122 in its radial direction. The first end portion and the second end portion are opposite end portions of the rolled tape 10 in the lengthwise direction. The first end portion corresponds to an upstream end portion of the tape 10 in the conveying direction. The second end portion corresponds to a downstream end portion of the tape 10 in the conveying direction. Though not illustrated, the terminal-end mark having a grid pattern is printed near an upstream end portion of the first surface 11A in the conveying direction. The printer 1 uses the sensor 29 (see FIG. 4) to detect the terminal-end mark to determine that a remaining amount of the tape 10 of the tape roll 122 is small.

The printer 1 cuts the printed tape 10 into the predetermined length to create a label piece. The user can peel the printing sheet 12 of the created label piece from the separation sheet 11 and stick the printing sheet 12 to an object such as a cable. The printer 1 according to the present embodiment may use a tape of a die-cut label type and a tape of a normal label type. Half cut is formed in the tape of the die-cut label type to divide the printing sheet 12 into a label portion and a non-label portion. No half cut is formed in the printing sheet 12 of the tape 10 of the normal label type.

There will be next described the tape 10A illustrated in FIG. 8 in detail. The tape 10A is of the die-cut label type for creating a label piece 201 having the fixed length. The printing sheet 12 has a plurality of half cuts 14 formed by half cut. In other words, each of the half cuts 14 extends through the printing sheet 12 but not through the separation sheet 11. Each of the half cuts 14 has a closed outline. Portions of the printing sheet 12 which are enclosed by the respective half cuts 14 serve as label portions 15. That is, the printing sheet 12 has the label portions 15 corresponding to the respective half cuts 14. Labels 15A are arranged at particular intervals in the lengthwise direction at a substantially central portion of the tape 10A in the widthwise direction. A portion of the printing sheet 12 which is different from the label portions 15 is a non-label portion 16. In the present example, the tape 10A has the non-label portion 16 as a portion of the printing sheet 12 but may not have the non-label portion 16 such that a portion of the separation sheet 11 which corresponds to the non-label portion 16 is exposed.

A plurality of remaining-amount indicating images 41 corresponding respectively to the labels 15A are printed on the first surface 11A of the separation sheet 11. The remaining-amount indicating images 41 are arranged at particular intervals in the lengthwise direction in a substantially central portion of the tape 10A in the widthwise direction. Each of the remaining-amount indicating images 41 indicates information relating to a remaining amount of the tape 10 that is an amount of a portion of the tape 10 of the tape roll 122, which portion is located upstream of a reference position in the conveying direction. The reference position is located upstream of the remaining-amount indicating image 41 in the conveying direction at a distance (as one example of a particular distance) corresponding to the particular interval from the remaining-amount indicating image 41 in the tape 10. For example, each of the particular intervals is a distance in the conveying direction from the remaining-amount indicating image 41 on the tape 10 discharged from the output guide 140 (see FIG. 3), to a position on the tape 10 at which printing is started next with consideration of, e.g., through-up (i.e., a position on the tape 10 which is located at the printing position at the start of the next printing). The printing position is a position at which printing is performed on the tape 10 by the thermal head 22.

Each of the label pieces 201 is separated from the tape roll 122 and has a fixed length. The label piece 201 includes one printed label 15A. On the first surface 11A of each of the label pieces 201, a corresponding one of the remaining-amount indicating images 41 is provided on the label 15A of the label piece 201. At least a portion of each of the remaining-amount indicating images 41 is located between opposite end portions of a corresponding one of the labels 15A in the lengthwise direction. In the present example, opposite end portions of each of the remaining-amount indicating image 41 in the lengthwise direction are located in the lengthwise direction between the opposite end portions of the corresponding label 15A in the lengthwise direction. The remaining-amount indicating image 41 is provided at a position on the first surface 11A which corresponds in the lengthwise direction and the widthwise direction to a region in which the corresponding label 15A is formed.

In the tape 10A, an upstream end portion of the label piece 201 (i.e., an upstream cut position C on the label piece 201) is the reference position corresponding to the remaining-amount indicating image 41 provided on the label piece 201. That is, the reference position is located between the label piece 201 containing the corresponding remaining-amount indicating image 41 and the label piece 201 located next to and upstream, in the conveying direction, of the label piece 201 containing the corresponding remaining-amount indicating image 41. Each of the remaining-amount indicating images 41 provided on the tape 10A indicates a label remaining amount as a remaining amount of the labels 15A. In the present example, the label remaining amount is the number of the labels 15A located upstream of the label piece 201 containing the remaining-amount indicating image 41 in the conveying direction in the tape roll 122.

As illustrated in FIGS. 4 and 8, the printer 1 draws the tape 10A from the tape roll 122 contained in the tape cassette 100 mounted on the cartridge holder 4, conveys the tape 10A, and controls the thermal head 22 to print an image on the label 15A. The printer 1 cuts the conveyed tape 10A at the cut position C, located upstream of the printed label 15A, based on the fixed label length W1. As a result, the label piece 201 of the label length W1 and with an image printed on the label 15A is formed. This enables the user to recognize the label remaining amount by visually checking the remaining-amount indicating image 41 formed on the created label piece 201.

There will be next described the tape 10B illustrated in FIG. 9 in detail. Since the tape 10B is of the normal label type for creating a label piece 202 having a variable length, the half cuts 14 and the label portions 15 (see FIG. 8) are not provided on the tape 10B. It is noted that the tape 10B may be of the normal label type for creating the label piece having the fixed length. It is noted that the same reference numerals as used for the tape 10A (see FIG. 8) are used to designate the corresponding elements of the tape 10B, and an explanation of which is dispensed with.

Similar to the tape 10A (see FIG. 8), the remaining-amount indicating images 41 are provided on the first surface 11A of the separation sheet 11. The remaining-amount indicating images 41 are arranged at particular intervals in the lengthwise direction at a substantially central portion of the tape 10B in the widthwise direction. In the tape 10B, the reference position corresponding to the remaining-amount indicating image 41 is located upstream of the remaining-amount indicating image 41 in the conveying direction at the distance L1 from the remaining-amount indicating image 41. The distance L1 is a distance between the printing position and a discharge position in the conveying direction in the printer 1 and corresponds to the particular interval. The discharge position is a position of the output guide 140 (see FIG. 3) at which the printed tape 10 is discharged to the outside of the tape cassette 100. One example of the distance L1 is 100 mm.

Each of the remaining-amount indicating images 41 of the tape 10B indicates a tape remaining amount that is a remaining amount of the tape 10B. The tape remaining amount in the present example is a length of a portion of the tape 10B of the tape roll 122 in the lengthwise direction of the tape 10B, which portion is located upstream of the reference position corresponding to the remaining-amount indicating image 41 in the conveying direction. In the present example, for two of the remaining-amount indicating images 41 which are adjacent to each other in the conveying direction, the length L0, in the conveying direction, from an upstream end portion of one of the two remaining-amount indicating images 41 to an upstream end portion of the other of the two remaining-amount indicating images 41 is equal to the distance L1. Accordingly, the other remaining-amount indicating image 41 located upstream of the one remaining-amount indicating image 41 indicates a tape remaining amount that is less than a tape remaining amount indicated by the one remaining-amount indicating image 41, by an amount corresponding to the distance L1 (100 mm in the present example).

The printer 1 draws the tape 10B from the tape roll 122 contained in the tape cassette 100 mounted on the cartridge holder 4, conveys the tape 10B, and controls the thermal head 22 to print an image on the fourth surface 12B of the printing sheet 12. The printer 1 cuts the printed tape 10B at a cut position based on a designated variable label length W2. As a result, the label piece 202 of the label length W2 and with an image printed on the fourth surface 12B is formed. This enables the user to recognize the label remaining amount by visually checking the remaining-amount indicating image 41 formed on the created label piece 202.

There will be next described the tape 10C illustrated in FIG. 10 in detail. Similar to the tape 10A (see FIG. 8), the tape 10C is of the die-cut label type for creating a label piece 203 having the fixed length. The label portions 15 corresponding to the respective half cuts 14 are formed in the printing sheet 12 of the tape 10C. In the present example, the label portions 15 are labels 15B each having a rectangular shape elongated in the lengthwise direction. The labels 15B are arranged at predetermined intervals in the lengthwise direction at a central region of the tape 10C in the widthwise direction. It is noted that the same reference numerals as used for the tape 10A are used to designate the corresponding elements of the tape 10C, and an explanation of which is dispensed with.

A plurality of label markers 42 are provided on the first surface 11A of the separation sheet 11. Each of the label markers 42 is a black region printed with ink containing black pigment. The label markers 42 are provided corresponding to the respective labels 15B and arranged at the particular intervals in the lengthwise direction. Each of the label markers 42 has a rectangular shape extending in the widthwise direction of the first surface 11A. Each of the label markers 42 is located downstream of a corresponding one of the labels 15B and upstream of a downstream label in the conveying direction in which the tape 10C is conveyed. The downstream label is one of the labels 15B which is located downstream of and adjacent to the corresponding one of the labels 15B in the conveying direction. Specifically, an upstream end portion of each of the label markers 42 is located downstream of a downstream end portion of the corresponding one of the labels 15B in the conveying direction. A downstream end portion of each of the label markers 42 is located upstream of an upstream end portion of the corresponding downstream label in the conveying direction. In the present example, each of the label markers 42 is located at the same position as a cut position C of an upstream end portion of a corresponding one of label pieces 203 which will be described below.

The remaining-amount markers 43 are provided on the first surface 11A of the separation sheet 11. The remaining-amount markers 43 are provided corresponding to the respective labels 15B so as to be arranged at particular intervals in the lengthwise direction. In each of the labels 15B, the remaining-amount marker 43 is located upstream of the label marker 42 in the conveying direction with a small space therebetween. In the present example, however, the label marker 42 is provided on but the remaining-amount marker 43 is not provided on the most upstream label 15B in the conveying direction (i.e., the trailing-end label 15B).

Each of the label pieces 203 is separated from the tape roll 122 and has a fixed length. The label piece 203 includes one printed label 15B. On the first surface 11A of each of the label pieces 203, a corresponding one of the remaining-amount markers 43 is provided on the label 15B of the label piece 203. At least a portion of each of the remaining-amount markers 43 is located between opposite end portions of a corresponding one of the labels 15B in the lengthwise direction. In the present example, opposite end portions of each of the remaining-amount indicating images 41 in the lengthwise direction are located in the lengthwise direction between the opposite end portions of the corresponding label 15B in the lengthwise direction. The remaining-amount indicating image 41 is provided on the first surface 11A at a position which corresponds in the lengthwise direction and the widthwise direction to a region in which the corresponding label 15B is formed.

Like the remaining-amount indicating images 41 provided on the tape 10A (see FIG. 8), each of the remaining-amount markers 43 indicates information relating to a remaining amount of the tape 10 that is an amount of a portion of the tape 10 of the tape roll 122, which portion is located upstream of the reference position in the conveying direction. In the present example, each of the remaining-amount markers 43 indicates a label remaining amount as a remaining amount of the labels 15B. In the present example, the label remaining amount is the number of the labels 15B located upstream of the label piece 203 including the remaining-amount marker 43 in the conveying direction in the tape roll 122.

Each of the remaining-amount markers 43 includes at least one black marker 43A. In the case where the remaining-amount marker 43 includes a plurality of the black markers 43A, the black markers 43A are arranged at particular intervals in the lengthwise direction. Each of the black markers 43A has a rectangular shape extending in the widthwise direction over the center of the first surface 11A in the widthwise direction. The length of each of the black markers 43A in the widthwise direction is less than the length of the label marker 42 in the widthwise direction. Each of the label markers 42 extends toward opposite sides of the black markers 43A in the widthwise direction beyond the black markers 43A in the widthwise direction. The marker length X2 that is a length of each of the black markers 43A in the lengthwise direction is less than the marker length X1 that is a length of each of the label markers 42 in the lengthwise direction. Each of the remaining-amount markers 43 indicates the label remaining amount by means of the number of the black markers 43A contained in the remaining-amount marker 43.

Each of the label markers 42 and each of the remaining-amount markers 43 are opposed to the detection hole 150 (see FIG. 6) in the thickness direction when the tape 10C is conveyed. Light L emitted from the optical sensor 56 (see FIG. 7) impinges on the label marker 42, the remaining-amount marker 43, the label marker 42, the remaining-amount marker 43, and so on in this order during conveyance of the tape 10C. In the case where the light L emitted from the optical sensor 56 does not impinge on the label markers 42 and the remaining-amount markers 43, the light L impinges on a portion of the first surface 11A which has the ground color, i.e., the white region. The printer 1 detects reflectivity T2 when the emitted light L impinges on any of the label markers 42 and the black markers 43A. The printer 1 detects reflectivity T1 when the emitted light L impinges on the portion of the first surface 11A which has the ground color (see FIG. 10). Since each of the label markers 42 and the black markers 43A is the black region darker than the ground color of the first surface 11A, the reflectivity T2 is less than the reflectivity T1.

As illustrated in FIGS. 4 and 10, the printer 1 draws the tape 10C from the tape roll 122 contained in the tape cassette 100 mounted on the cartridge holder 4 and conveys the tape 10C. The control circuit, not illustrated, of the printer 1 prestores a particular intensity of the light L to be emitted. The optical sensor 56 emits the light L of the particular intensity through the detection hole 150 to the first surface 11A of the tape 10C conveyed in the arm 160 and receives the light reflected from the first surface 11A. The printer 1 detects, as reflectivity, the intensity of the received reflected light. The printer 1 detects the reflectivity T2 when the light L is emitted to any of the label markers 42 and the remaining-amount markers 43, and detects the reflectivity T1 when the light L is emitted to the portion of the first surface 11A which has the ground color. In the case where the length corresponding to the detected time of the reflectivity T2 in the conveying direction is the marker length X1, the printer 1 determines that the label marker 42 is detected. In the case where the length corresponding to the detected time of the reflectivity T2 in the conveying direction is the marker length X2, the printer 1 determines that the black marker 43A is detected.

In the present example, the control circuit, not illustrated, of the printer 1 stores label information relating to each of the labels 15B, in association with the reflectivity T2 with the marker length X1. The label information relating to each of the labels 15B indicates the label length W3 of the label piece 203 including the label 15B, and the position, the shape, and the size of the label 15B in the label piece 203, for example. In the case where the reflectivity T2 with the marker length X1 is detected, the printer 1 prints an image on the label 15B of the conveyed tape 10C based on the label information relating to the label 15B. The printer 1 cuts the conveyed tape 10C at the cut position located upstream of the printed label 15B, to create the label piece 203 having an appropriate length with an image printed at an appropriate position in the label 15B.

In the case where the reflectivity T2 with the marker length X2 (i.e., the black marker 43A of the remaining-amount marker 43) is detected, the printer 1 can identify the label remaining amount based on the number of successive detections of the black markers 43A. In the present example, the label length W3 of the label piece 203 is less than the distance L2. The distance L2 is a distance between the printing position and a marker detecting position in the conveying direction in the printer 1. The marker detecting position is a position at which the light L emitted from the optical sensor 56 impinges on the tape 10. In this case, the printer 1 identifies, as the label remaining amount, the number obtained by adding one to the number of the detected black markers 43A. For example, in the case where the number of the detected black markers 43A is three, the printer 1 identifies four as the label remaining amount. The printer 1 may make notification about the identified remaining amount at the start or the end of printing on the tape 10C, for example. The printer 1 may make an alert in the case where the identified label remaining amount is less than or equal to a predetermined threshold value.

There will be next described a reason why the printer 1 identifies the label remaining amount as described above. In the printer 1, the marker detecting position is located upstream of the printing position in the conveying direction. As illustrated in FIG. 10, when the tape 10C is cut at the cut position, one of the labels 15B (an upstream label) which is located upstream of and next to the created label piece 203 is disposed between the cut position and the marker detecting position. The remaining-amount marker 43 last detected by the optical sensor 56 at this time is the remaining-amount marker 43 corresponding to the upstream label. Since the upstream label has not been printed yet by the thermal head 22, the upstream label is included in the tape roll 122. Accordingly, the printer 1 adds one, corresponding to the one upstream label, to the number of the black markers 43A which is identified from the remaining-amount marker 43, and the printer 1 identifies the obtained value as the label remaining amount, i.e., the number of the printable labels 15B.

This configuration enables the user to identify the label remaining amount by visually checking the remaining-amount marker 43 provided on the created label piece 203. For example, in the case where the number of the black markers 43A contained in the remaining-amount marker 43 is three, the user can recognize that the label remaining amount is three.

In the present embodiment as described above, the tape cassette 100 includes the cassette casing 101 and the tape roll 122. The tape roll 122 is a roll of the tape 10 (the tapes 10A-10C) contained in the cassette casing 101 and having a strip shape extending in the lengthwise direction and the widthwise direction orthogonal to the lengthwise direction. The tape 10 has a subject surface (i.e., the first surface 11A and the fourth surface 12B) located on the tape 10 and exposed in the thickness direction orthogonal to each of the lengthwise direction and the widthwise direction. A first image (e.g., each of the remaining-amount indicating images 41 and the remaining-amount markers 43) is provided on the subject surface and indicates first information.

The tape roll 122 has the first end portion and the second end portion as opposite end portions of the rolled tape 10 in its lengthwise direction. The first end portion is the upstream end portion of the tape 10 in the conveying direction, which is an inner portion of the tape roll 122 in its radial direction. The second end portion is the downstream end portion of the tape 10 in the conveying direction, which is an outer portion of the tape roll 122 in its radial direction. The first information is information relating to a remaining amount of the tape 10 that is an amount of a portion of the tape 10 of the tape roll 122, which portion is located on a first-end-portion-side of the reference position in the lengthwise direction. In other words, the portion of the tape 10 of the tape roll 122 is located on a side of the reference position, which side is nearer to the first end portion than to the second portion. The reference position is nearer to the first end portion than the first image in the lengthwise direction in the tape 10 by a distance corresponding to the particular interval.

With this configuration, in the case where the label piece is created by cutting the tape 10 at a position nearer to the second end portion than to the first end portion, for example, the user can recognize information relating to a remaining amount of the tape 10 in the tape roll 122 (i.e., the label remaining amount or the tape remaining amount) by visually checking the first image (the remaining-amount indicating image 41 or the remaining-amount marker 43) provided on the created label piece. That is, the user can accurately identify not the remaining amount of the tape 10 containing the created label piece but the remaining amount of the tape 10 excluding the created label piece (i.e., the remaining amount of the tape 10 remaining in the printer 1).

The tape 10 (the tapes 10A, 10C) includes the separation sheet 11 and the printing sheet 12. The printing sheet 12 has the printing layer 18 and the adhesive layer 19 provided on the printing layer 18, and the printing sheet 12 is peelably stuck to the separation sheet 11 with the adhesive layer 19 interposed therebetween. The printing sheet 12 includes a plurality of die-cut labels (i.e., the labels 15A, 15B) arranged in the lengthwise direction. The first image (the remaining-amount indicating image 41 or the remaining-amount marker 43) is provided corresponding to the subject label that is one of the die-cut labels. The first information indicates a label remaining amount that is the number of the die-cut labels located on a first-end-portion-side of the reference position in the lengthwise direction in the tape roll 122. The reference position is located between the subject label and the die-cut label adjacent to and located on the first-end-portion-side of the subject label.

With this configuration, the first image indicates the number of the die-cut labels located on the first-end-portion-side, in the lengthwise direction, of the die-cut label on which the first image is provided. In the case where the label piece is created by cutting the tape 10 at a position nearer to the second end portion than to the first end portion, for example, the user can recognize the label remaining amount in the tape roll 122 by visually checking the first image provided on the created label piece.

The subject surface is provided with the markers (e.g., the label markers 42) different from the first images and corresponding to the respective die-cut labels (e.g., the labels 15B). At least a portion of each of the markers is provided, in the widthwise direction, outside a region on which a corresponding one of the first images (e.g., the remaining-amount markers 43) is formed. With this configuration, at least a portion of each of the markers is located at a position different from that of the corresponding first image in the widthwise direction, making it easy for the user to visually distinguish between the marker and the first image. For example, the printer 1 emits the light L to a position on the marker which is located outside the first image in the widthwise direction, thereby optically detecting only the marker.

The subject surface is provided with the markers (e.g., the label markers 42) different from the first images and corresponding to the respective die-cut labels (e.g., the labels 15B). At least a portion of each of the markers is provided, in the widthwise direction, within a region on which a corresponding one of the first images (e.g., the remaining-amount markers 43) is formed. With this configuration, at least a portion of each of the markers is located at the same position as that of the corresponding first image in the widthwise direction, enabling the printer 1 to optically detect both of the marker and the first image by emitting the light L to a particular position in the widthwise direction.

Each of the first images (e.g., the remaining-amount markers 43) is formed on the first-end-portion-side, in the lengthwise direction, of a subject marker corresponding to the first image among a plurality of markers (e.g., the label markers 42) in the tape roll 122. The first image includes at least one marker (e.g., the black markers 43A), the number of which relates to the label remaining amount indicated by the first information. With this configuration, in the case where the label piece is created by cutting the tape 10 at a position nearer to the second end portion than to the first end portion, for example, the number of the marks contained in the first image provided on the created label piece enables the user to recognize the label remaining amount corresponding to the number of the marks.

At least a portion of the first image (e.g., the remaining-amount indicating image 41 or the remaining-amount marker 43) is located between opposite end portions of the subject label in the lengthwise direction. With this configuration, at least a portion of the first image is disposed on the created label piece. Preferably, opposite end portions of the first image in the lengthwise direction are located between the opposite end portions of the subject label in the lengthwise direction. With this configuration, the entire first image is disposed on the created label piece.

Each of the markers are provided between corresponding adjacent two of the die-cut labels arranged at particular intervals in the lengthwise direction. A portion of the tape 10 which is located between the two die-cut labels in the lengthwise direction is a margin which is cut in creation of the label piece. Since the markers are provided on the margin, the margin of the tape 10 is effectively used.

The tape 10 has a plurality of the first images provided on the subject surface. With this configuration, in the case where a plurality of the label pieces are created from the tape 10, for example, the user can accurately identify the remaining amount of the tape 10 remaining in the printer 1, based on the first image of the most recently created label piece. Also, the first images correspond to the respective die-cut labels, that is, one to one correspondence is established. This configuration enables the first image to be disposed on the corresponding created label piece each time when the label piece is created from the tape 10, for example.

The subject surface is the first surface 11A that is one of opposite surfaces of the separation sheet 11, the other of which is the second surface 11B peelably stuck to the printing sheet 12. The first image is provided on the subject surface at a position corresponding in the lengthwise direction and the widthwise direction to a region at which the subject label is formed. This configuration enables the first image to be disposed on the tape 10 at a region overlapping the subject label in the thickness direction.

While the embodiment has been described above, it is to be understood that the disclosure is not limited to the details of the illustrated embodiment, but may be embodied with various changes and modifications, which may occur to those skilled in the art, without departing from the spirit and scope of the disclosure. The tape 10 is not limited to the tape for label creation and may be a tape constituted by a single-layer substrate without an adhesive layer (e.g., a single-layer tape for thermal printing). The printer 1 may use the sensor 29 (see FIG. 4) to detect the label markers 42 and the remaining-amount markers 43 formed on the first surface 11A of the separation sheet 11. At least one of each remaining-amount indicating image 41, each label marker 42, and each remaining-amount marker 43 may be provided on the fourth surface 12B of the printing sheet 12, preferably on the non-label portion 16. In this case, the printer 1 may include an optical sensor capable of optically the label markers 42 and the remaining-amount markers 43 formed on the fourth surface 12B.

The remaining-amount indicating images 41, the label markers 42, and the remaining-amount markers 43 may be changed in position, size, shape, the number, and so on without departing from the spirit and scope of the disclosure. For example, in the case where the tape 10 is of the die-cut label type, at least one of each remaining-amount indicating image 41, each label marker 42, and each remaining-amount marker 43 may be provided on a portion of the second surface 11B of the separation sheet 11 which is opposed to the non-label portion 16 (i.e., a portion of the second surface 11B which is not opposed to the label portion 15).

Figure 11:
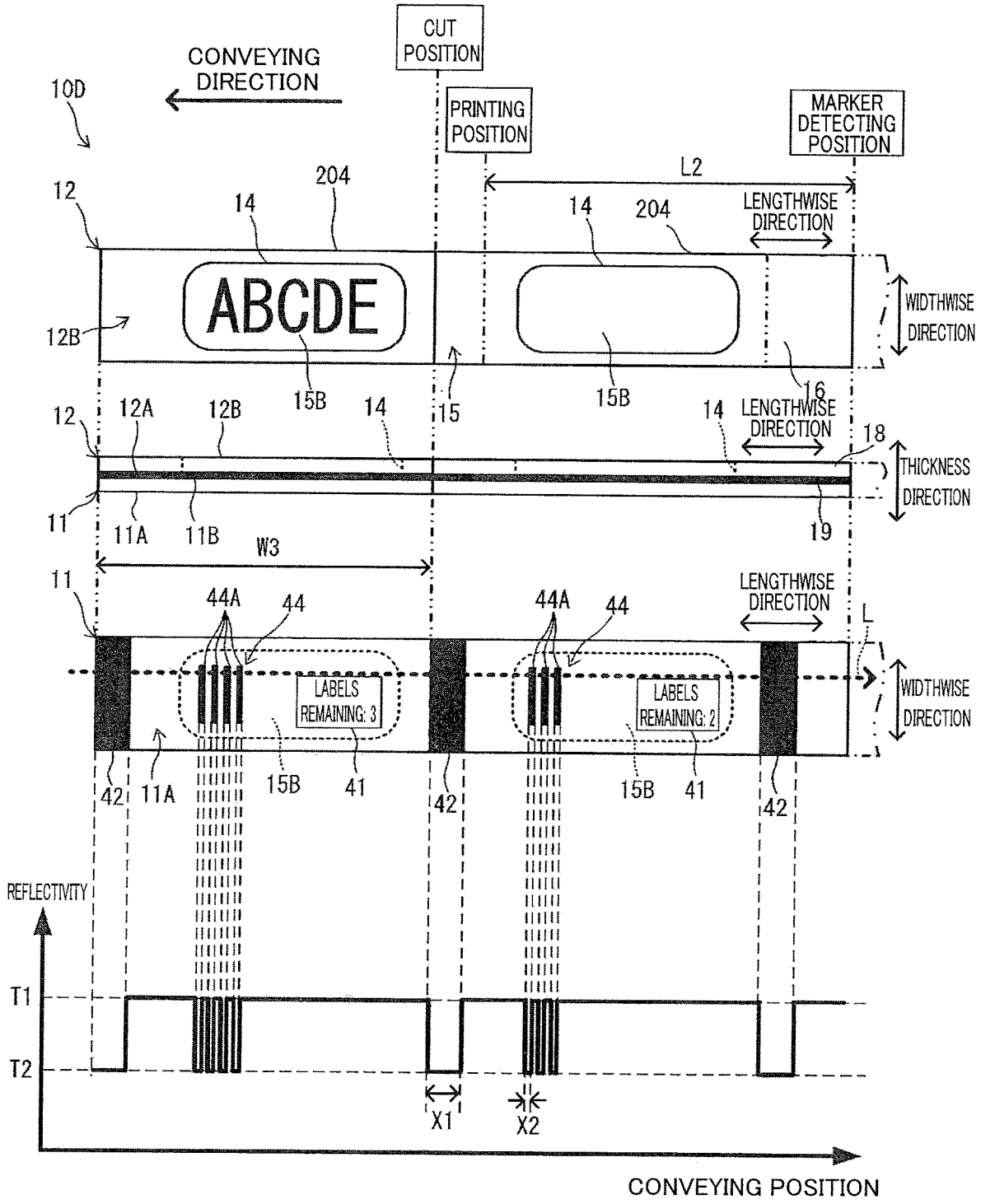
FIG. 11 is a view for explaining a tape 10D.

There will be next described a configuration of a tape 10D according to a modification of the tape 10 with reference to FIG. 11. The tape 10D is similar in configuration to the tape 10C (see FIG. 10) but different from the tape 10C in a configuration described below. It is noted that the same reference numerals as used for the tape 10C are used to designate the corresponding elements of the tape 10D, and an explanation of which is dispensed with.

A plurality of detection remaining-amount markers 44 corresponding to the respective labels 15B are provided on the first surface 11A of the separation sheet 11 instead of the remaining-amount markers 43 (see FIG. 10). Each of the detection remaining-amount markers 44 is similar in configuration to each of the remaining-amount markers 43 and includes at least one black marker 44A. Each of the detection remaining-amount markers 44 is used for the optical sensor 56 (see FIG. 7) to detect the label remaining amount relating to a corresponding one of the labels 15B. Each of the detection remaining-amount markers 44 indicates a label remaining amount different from a label remaining amount indicated by a corresponding one of the remaining-amount indicating images 41 which will be described below.

Similar to the tape 10A (see FIG. 8), the remaining-amount indicating images 41 are further provided on the first surface 11A. The remaining-amount indicating images 41 are provided corresponding to the respective labels 15B and arranged at particular intervals in the lengthwise direction. In each of the labels 15B, the remaining-amount indicating images 41 is located upstream of the detection remaining-amount markers 44 in the conveying direction with a small space therebetween. In the present example, however, the detection remaining-amount marker 44 and the remaining-amount indicating image 41 are not provided on the most upstream label 15B in the conveying direction (i.e., the trailing-end label 15B).

Each of label pieces 204 is separated from the tape roll 122 and has a fixed length. The label piece 204 includes one printed label 15B. On the first surface 11A of each of the label piece 204, a corresponding one of the detection remaining-amount markers 44 and a corresponding one of the remaining-amount indicating images 41 are provided on the label 15B of the label piece 204. In the present example, the detection remaining-amount marker 44 and the remaining-amount indicating image 41 are provided on the first surface 11A respectively at positions which correspond in the lengthwise direction and the widthwise direction to a region in which the corresponding label 15B is formed.

Similar to the tape 10A (see FIG. 8), each of the remaining-amount indicating images 41 indicates, as the label remaining amount, the number of the labels 15B located upstream of the label piece 204 including the remaining-amount indicating image 41 in the conveying direction in the tape roll 122. Each of the detection remaining-amount markers 44 indicates, as the label remaining amount, the total number of the label 15B of the label piece 204 including the detection remaining-amount marker 44, and the label or labels 15B located upstream of the label piece 204 in the conveying direction. Accordingly, for each of the labels 15B, the label remaining amount indicated by a corresponding one of the detection remaining-amount markers 44 is greater than the label remaining amount indicated by a corresponding one of the remaining-amount indicating images 41. In the present example, the label length W3 of the label piece 204 is less than the distance L2. In this case, the label remaining amount indicated by each of the detection remaining-amount markers 44 is greater by one than the label remaining amount indicated by the corresponding remaining-amount indicating image 41.

There will be next described a reason why the label remaining amount indicated by each of the detection remaining-amount markers 44 is greater by one than the label remaining amount indicated by the corresponding remaining-amount indicating image 41 in the present example. As described above, the marker detecting position is located upstream of the printing position in the conveying direction in the printer 1. In the case where the detection remaining-amount marker 44 is detected by the optical sensor 56, the label 15B corresponding to the detected detection remaining-amount marker 44 has not been printed yet by the thermal head 22, and thus the tape roll 122 includes the label 15B. Accordingly, each of the detection remaining-amount markers 44 is formed in the tape 10D so as to indicate a number that is greater by one than the corresponding remaining-amount indicating image 41.

As illustrated in FIGS. 4 and 11, the light L emitted from the optical sensor 56 (see FIG. 7) impinges on the label marker 42, the detection remaining-amount marker 44, the label marker 42, the detection remaining-amount marker 44, and so on in this order during conveyance of the tape 10D. The printer 1 performs printing and label creation for the tape 10D as for the tape 10C (see FIG. 10). That is, in the case where the reflectivity T2 with the marker length X1 (i.e., the label marker 42) is detected, the printer 1 prints an image on the label 15B based on label information relating thereto and cuts the tape 10D at a cut position located upstream of the printed label 15B to create the label piece 204.

In the case where the reflectivity T2 with the marker length X2 (i.e., the black marker 44A of the detection remaining-amount marker 44) is detected, the printer 1 can identify the label remaining amount based on the number of successive detections of the black markers 44A. In the present example, the number of the labels for the printer 1 to identify the label remaining amount is indicated by the detection remaining-amount marker 44 in advance, independently of the remaining-amount indicating image 41 for the user to identify the label remaining amount by visual check. Thus, the printer 1 identifies the number of the detected black markers 44A as the label remaining amount. For example, in the case where the number of the detected black markers 44A is three, the printer 1 identifies three as the label remaining amount. This configuration enables the user to identify the label remaining amount by visually checking the remaining-amount indicating image 41 of the created label piece 204. For example, in the case where the remaining-amount indicating image 41 indicates two, the user can recognize that the label remaining amount is two.

Figure 12:
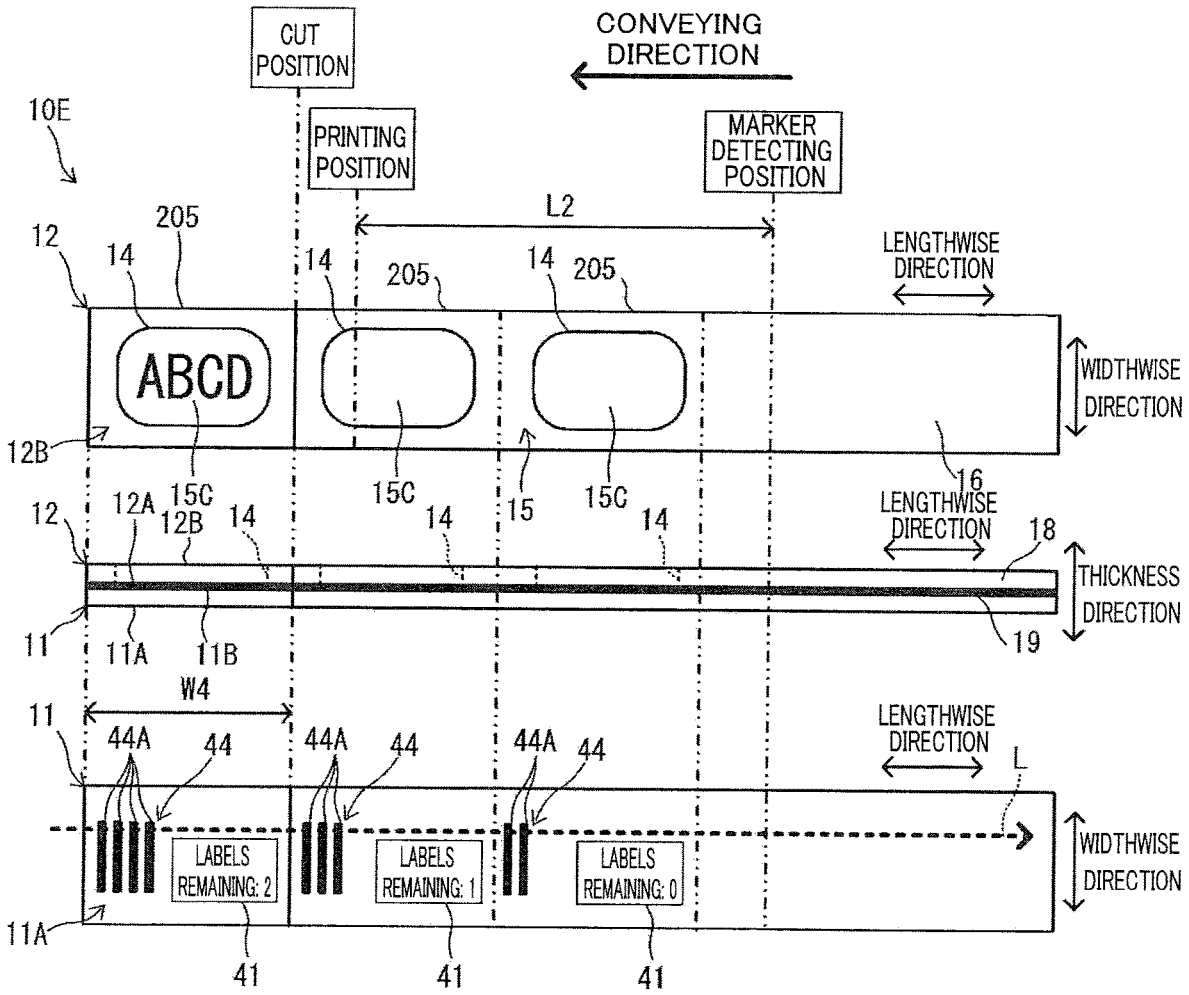
FIG. 12 is a view for explaining a tape 10E.

There will be next described a configuration of a tape 10E according to a modification of the tape 10 with reference to FIG. 12. The tape 10E is similar in configuration to the tape 10D (see FIG. 11) but different from the tape 10D in a configuration described below. It is noted that the same reference numerals as used for the tape 10D are used to designate the corresponding elements of the tape 10E, and an explanation of which is dispensed with.

Similar to the tape 10D, the detection remaining-amount markers 44 and the remaining-amount indicating images 41 are provided on the first surface 11A of the separation sheet 11 such that each of the detection remaining-amount markers 44 and each of the remaining-amount indicating images 41 correspond to a corresponding one of the labels 15C. In the present example, however, the label markers 42 (see FIG. 11) are not provided on the first surface 11A. As in the above-described modification, the detection remaining-amount marker 44 and the remaining-amount indicating image 41 corresponding to each of the labels 15C respectively indicate numbers different from each other as a label remaining amount for the label 15C.

Each of label pieces 205 is separated from the tape roll 122 and has a fixed length. The label piece 205 includes one printed label 15C. In the present example, the label length W4 of the label piece 205 is less than half the distance L2. In this case, for each of the labels 15C, the number of the labels which is indicated by the detection remaining-amount marker 44 is greater by two than the number of the labels which is indicated by the remaining-amount indicating image 41.

There will be next described a reason why the label remaining amount indicated by each of the detection remaining-amount markers 44 is greater by two than the label remaining amount indicated by the corresponding remaining-amount indicating image 41 in the present example. When the tape 10E is cut at a cut position, as illustrated in FIG. 12, a plurality of the labels 15C (the upstream labels) located upstream of the created label piece 205 are disposed between the cut position and the marker detecting position. Since the label length W4 is less than half the distance L2 in the present example, two upstream labels are provided between the cut position and the marker detecting position. At this time, the detection remaining-amount marker 44 most recently detected by the optical sensor 56 is the upstream detection remaining-amount marker 44 detected most recently among the detection remaining-amount markers 44 corresponding respectively to the two upstream labels. The two upstream labels have not been printed yet by the thermal head 22, and thus the tape roll 122 includes the two upstream labels. Accordingly, each of the detection remaining-amount markers 44 is formed in the tape 10E so as to indicate a number that is greater by two than the corresponding remaining-amount indicating image 41.

As illustrated in FIGS. 4 and 12, the printer 1 creates the label piece 205 of the label length W4 and with an image printed on the label 15C as in the above-described modification. In the case where the reflectivity T2 with the marker length X2 (i.e., the black marker 44A of the detection remaining-amount marker 44) is detected, the printer 1 can identify the label remaining amount based on the number of the black markers 44A. For example, in the case where the number of the detected black markers 44A is two, the printer 1 identifies two as the label remaining amount. This configuration enables the user to identify the label remaining amount by visually checking the remaining-amount indicating image 41 of the created label piece 205. For example, in the case where the remaining-amount indicating image 41 indicates two, the user can recognize that the label remaining amount is two.

It is noted that, as indicated by the tapes 10D, 10E, each of the tape remaining amount indicated by the detection remaining-amount marker 44 and the tape remaining amount indicated by the remaining-amount indicating image 41 at least needs to be set to an appropriate value, depending upon a relationship between the label length of the label piece to be created and the distance L2 between the printing position and the marker detecting position. That is, each of the tape remaining amount indicated by the detection remaining-amount marker 44 and the tape remaining amount indicated by the remaining-amount indicating image 41 depends upon the relationship between the label length and the distance L2. Accordingly, in the case where the label length is greater than the distance L2, for example, the detection remaining-amount marker 44 and the remaining-amount indicating image 41 provided for each label piece may indicate the same tape remaining amount.

The tape 10 according to the present modification (e.g., the tapes 10D, 10E) includes a second image (e.g., the detection remaining-amount markers 44) provided on the subject surface so as to correspond to the subject label and indicate second information. The second information indicates the number of the die-cut labels (e.g., the labels 15B, 15C) which is different from the label remaining amount indicated by the first information. This configuration enables the user to recognize the label remaining amount based on the first image (e.g., the remaining-amount indicating image 41) provided on the created label piece (e.g., the label pieces 204, 205). The printer 1 can identify the label remaining amount based on the second image provided on the label piece that has not been created yet. Thus, the user and the printer 1 can accurately recognize the label remaining amount even in the case where the timings when the label remaining amount is checked by the user and the printer 1 are different from each other.

The second information indicates the number of the die-cut labels (e.g., the labels 15B) which is obtained by adding one to the label remaining amount indicated by the first information. This configuration enables the printer 1 to accurately identify the label remaining amount based on the second image provided on the label piece (e.g., the label piece 204) that has not been created yet. The second image is provided on the first-end-portion-side of the first image in the lengthwise direction. This configuration enables the printer 1 to accurately identify the label remaining amount based on the second image corresponding to the die-cut label that has not been created yet.

What is claimed is:

1. A tape cassette, comprising:

a cassette casing; and a tape roll that is contained in the cassette casing and that is a roll of a tape having a strip shape and extending in a lengthwise direction and a widthwise direction orthogonal to the lengthwise direction, wherein the tape comprises:

a subject surface provided on the tape and exposed in a thickness direction orthogonal to each of the lengthwise direction and the widthwise direction; and a first image provided on the subject surface and indicating first information, wherein the tape roll comprises: a first end portion located at an inner portion of the tape roll in a radial direction of the tape roll; and a second end portion located at an outer portion of the tape roll in the radial direction, and the first end portion and the second end portion are opposite end portions of the roll of the tape in the lengthwise direction, wherein the first information relates to a remaining amount of the tape that is an amount of a portion of the tape which is located on a first-end-portion-side of a reference position in the lengthwise direction in the tape roll, and wherein the reference position is located on the first-end-portion-side of the first image in the lengthwise direction on the tape at a particular distance from the first image.

2. The tape cassette according to claim 1, wherein the tape comprises:

a first sheet; and a second sheet comprising a printing layer and an adhesive layer provided on the printing layer, the second sheet peelably stuck to the first sheet via the adhesive layer, wherein the second sheet comprises a plurality of die-cut labels arranged in the lengthwise direction, wherein the first image is provided corresponding to a subject label that is one of the plurality of die-cut labels, wherein the first information relates to a label remaining amount that is the number of the plurality of die-cut labels located on the first-end-portion-side of the reference position in the lengthwise direction in the tape roll, and wherein the reference position is located between the subject label and one of the plurality of die-cut labels which is located adjacent to and on the first-end-portion-side of the subject label.

3. The tape cassette according to claim 2, wherein the subject surface is one of opposite surfaces of the first sheet, the other of which is a surface to which the second sheet is peelably stuck, and wherein the first image is formed on the subject surface at a position corresponding, in the lengthwise direction and the widthwise direction, to a region at which the subject label is formed.

4. The tape cassette according to claim 2, wherein a plurality of markers different from the first image are provided on the subject surface so as to correspond respectively to the plurality of die-cut labels, and wherein at least a portion of the plurality of markers is provided within a region at which the first image is formed in the widthwise direction.

5. The tape cassette according to claim 2, wherein a plurality of markers different from the first image are provided on the subject surface so as to correspond respectively to the plurality of die-cut labels, and wherein at least a portion of the plurality of markers is provided outside a region at which the first image is formed in the widthwise direction.

6. The tape cassette according to claim 5, wherein the first image is located on the first-end-portion-side of a subject marker in the lengthwise direction in the tape roll, and the subject marker is one of the plurality of markers which corresponds to the first image, and wherein the first image comprises at least one mark, the number of which relates to the label remaining amount indicated by the first information.

7. The tape cassette according to claim 5, wherein each of the plurality of markers is provided between corresponding adjacent two of the plurality of die-cut labels which are arranged at a particular interval in the lengthwise direction.

8. The tape cassette according to claim 2, wherein at least a portion of the first image is located between opposite end portions of the subject label in the lengthwise direction.

9. The tape cassette according to claim 8, wherein opposite end portions of the first image in the lengthwise direction are disposed in the lengthwise direction between the opposite end portions of the subject label in the lengthwise direction.

10. The tape cassette according to claim 2, wherein the tape comprises a second image indicating second information and provided on the subject surface so as to correspond to the subject label, and wherein the second information indicates the number of the die-cut labels which is different from the label remaining amount indicated by the first information.

11. The tape cassette according to claim 10, wherein the second information indicates the number of the die-cut labels which is obtained by adding one to the label remaining amount indicated by the first information.

12. The tape cassette according to claim 10, wherein the second image is located on the first-end-portion-side of the first image in the lengthwise direction.

13. The tape cassette according to claim 2, wherein the tape comprises a plurality of first images, as the first image, which are provided on the subject surface.

14. The tape cassette according to claim 13, wherein the plurality of first images correspond respectively to the plurality of die-cut labels.

* * * * *